US006779790B2

(12) United States Patent
Kitahara

(10) Patent No.: US 6,779,790 B2
(45) **Date of Patent: *Aug. 24, 2004**

(54) SHEET PROCESSING APPARATUS FOR BINDING SHEET STACKS IN ONE OF AN END BINDING MODE AND A CENTRAL BINDING MODE, AND IMAGE FORMING APPARATUS CONTAINING SAME

(75) Inventor: Yoshihiko Kitahara, Yokohama (JP)

(73) Assignee: Canon Aptex Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 214 days.

(21) Appl. No.: 09/452,372

(22) Filed: Dec. 1, 1999

(65) Prior Publication Data

US 2003/0094745 A1 May 22, 2003

(30) Foreign Application Priority Data

Dec. 4, 1998 (JP) ..... 10-345749

(51) Int. Cl.[7] ..... B41L 43/12

(52) U.S. Cl. ..... 270/58.12; 220/58.11; 220/58.08; 493/444; 493/385

(58) Field of Search ..... 270/37, 32, 58.07, 270/58.08, 58.09, 58.11, 58.12, 58.13, 58.14, 58.16; 493/383, 384, 385, 444

(56) References Cited

U.S. PATENT DOCUMENTS

| | | | | |
|---|---|---|---|---|
| 5,442,432 | A | 8/1995 | Tani | 355/324 |
| 5,839,045 | A | 11/1998 | Wierszewski | 399/382 |
| 5,881,352 | A | 3/1999 | Kobayashi et al. | 399/408 |
| 5,913,099 | A | 6/1999 | Kamei et al. | 399/296 |
| 5,992,838 | A | 11/1999 | Saitoh | 270/58.09 |
| 6,022,011 | A | 2/2000 | Hirose | 270/37 |

FOREIGN PATENT DOCUMENTS

| | | |
|---|---|---|
| DE | 197 19 485 | 1/1998 |
| EP | 0 792 832 | 9/1997 |
| JP | 07-187479 | 7/1995 |
| JP | 09-086770 | 3/1997 |
| JP | 10-181990 | 7/1998 |

*Primary Examiner*—Patrick Mackey
(74) *Attorney, Agent, or Firm*—Fitzpatrick, Cella, Harper & Scinto

(57) ABSTRACT

The present invention relates to a sheet processing apparatus comprising, sheet stacking means for stacking sheet, sheet binding means for binding a sheets and conveying means for conveying the sheet stacked on the sheet stacking means so as to change sheet binding positions. According to the present invention, the sheet binding means, the conveying means can be used commonly, so that the costs for parts can be reduced, and so that a compact sheet processing apparatus can he provided in terms of apparatus capacity.

32 Claims, 8 Drawing Sheets

SHEET PROCESSING APPARATUS FOR BINDING SHEET STACKS IN ONE OF AN END BINDING MODE AND A CENTRAL BINDING MODE, AND IMAGE FORMING APPARATUS CONTAINING SAME

BACKGROUND OF THE INVENTION

1. Field of the Invention

This invention relates to a sheet processing apparatus and, more particularly, to a sheet processing apparatus implementing processes such as folding, sorting, stapling, and the like for sheets upon sequentially introducing the sheets within the sheet processing apparatus where the sheets, e.g., copy sheets, are delivered from an image forming apparatus such as, e.g., a photocopier, a printer, and a facsimile machine and such an image forming apparatus having this sheet processing apparatus.

2. Description of Related Art

FIG. 8 schematically shows an inner structure of a photocopier as an example of a normal image forming apparatus. The photocopier shown in FIG. 8 is constituted by connecting an image forming apparatus body A with a sheet processing apparatus B. The sheet processing apparatus B is made of a finisher unit C capable of sorting the sheets on which images are recorded at the image forming apparatus body A on the basis of each copy, and a stitcher unit D capable of binding and stitching plural sheets.

The image forming apparatus optically reads by an optical means 302 image information on an original document automatically fed from an original document feeding apparatus 301 mounted on an upper portion of the apparatus body and transmits image information as a digital signal to an image forming means 303 to make recording on recording sheets such as plain papers and OHP sheets.

Meanwhile, the finisher unit C in the sheet processing apparatus B, when discharging sheets on a stacking tray 318, can do a discharge processing corresponding to respective modes such as an offset mode, a staple mode, and the like, in addition to normal discharge mode and normal stack mode. The staple mode, among those processing modes, is an operation mode for, when discharging sheets upon sorting the sheets on the basis of each copy, stacking sheets orderly on a staple tray 312, stapling the sheets with a stapler 313, and discharging the sheets upon binding the sheets on the basis of each copy.

The stitcher unit D in the sheet processing apparatus B is to align the sheets delivered from the image forming apparatus body A on the basis of each copy, to make stapling by the staple unit, and to fold the sheets into folios to bind booklets. More specifically, the sheets delivered from the image forming apparatus body A are conveyed to a vertical path 360 of the stitcher unit D, and the sheets are orderly stacked so that the lower end of the sheet is in contact with a stopper 362. Those sheets are stapled at two positions at a central position in a sheet length direction (sheet conveyance direction) by the stapler unit 361 and are bound. The stopper 362 is moved downward the sheets so that the stapled positions reach a nip position of a folding roller 378. A pushing plate 379 hits the stapled positions, and the folding roller 378 conveys the sheets by nipping the sheets so that the sheets is folded in folio. This operation makes the sheets stapled at a center in the sheet length direction and makes the bound sheets in folio discharged on the stack tray 380.

However, since the sheet processing apparatus B is constituted separately of the finisher unit C and the stitcher unit D, the conventional apparatus raised the following problems.

For the stapler for stapling bundles made of plural sheets, at least one stapler (stapler 313 in FIG. 8) is needed in the finisher unit C, and another stapler (staple unit 361 in FIG. 8) is needed in the stitcher unit D, so that at least two staplers are needed in total.

Furthermore, conveying means or aligning means is also needed for respective units, e.g., finisher, and stitcher, constituting the sheet processing apparatus. The conventional sheet processing apparatus B thus had multiply similar mechanisms such as stapler, conveying means, aligning means, or the like, so that the apparatus required more costs and spaces.

It is an object of the invention to provide a sheet processing apparatus inexpensive having a smaller amount of useless spaces.

SUMMARY OF THE INVENTION

To accomplish the above object, a sheet processing apparatus comprising: sheet stacking means for stacking sheet; sheet binding means for binding a sheets; and conveying means for conveying the sheet stacked on the sheet stacking means so as to change sheet binding positions.

As a result, the sheet binding means, the conveying means can be used commonly, so that the costs for parts can be reduced, and so that a compact sheet processing apparatus can be provided in terms of apparatus capacity.

DETAILED DESCRIPTION OF THE PREFERRED EMBODIMENTS

Figure 1:
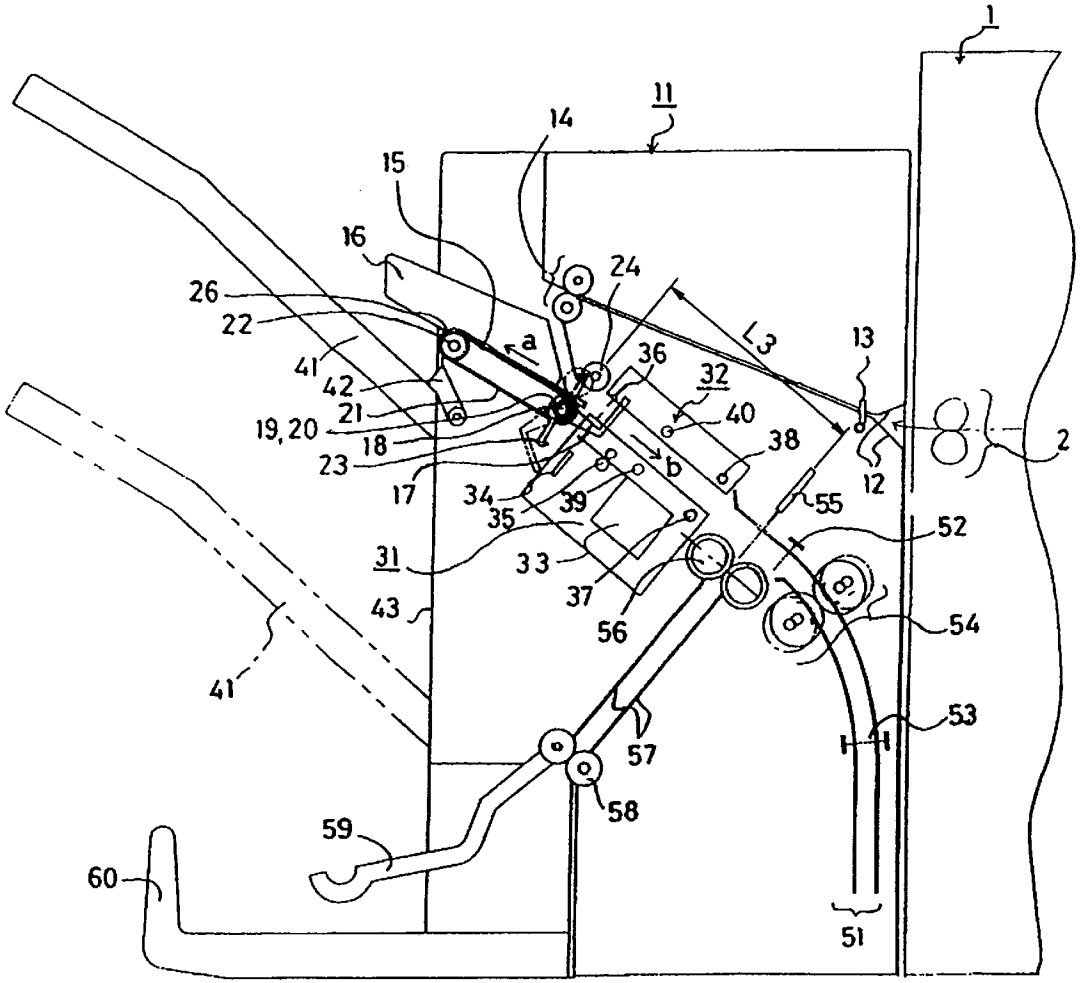
FIG. 1 is a main cross section showing a finisher according to a first embodiment.

Referring to the drawings, image forming apparatuses having respective sheet processing apparatuses to which the invention applies as embodiments are described below.

[First Embodiment]

Referring to the drawings, an image forming apparatus having a sheet processing apparatus according to the first embodiment is described using the drawings. FIG. 1 is a main cross section showing a finisher according to the first embodiment.

Figure 8:
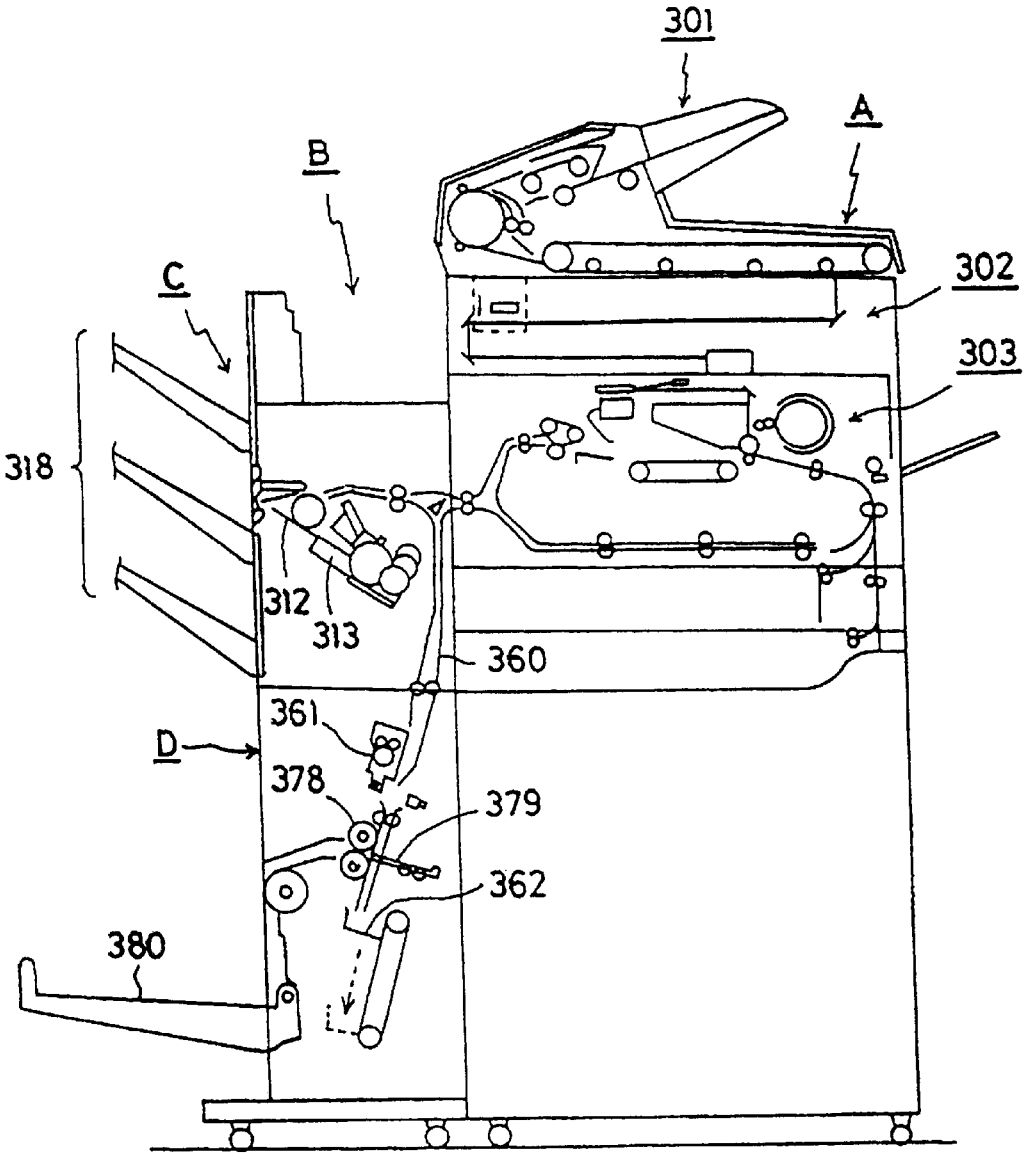
FIG. 8 is an illustration showing a prior art.

In FIG. 1, numeral 1 represents an image forming apparatus body constituting an image forming apparatus such as a photocopier, printer, or the like. It is to be noted that the inner structure of the image forming apparatus body 1 is not shown specifically, but the image forming apparatus body includes an image forming means for forming images on a sheet (e.g., image forming means 303 shown in FIG. 8), a delivery roller pair 2 for delivering outside the apparatus the sheets processed by the image forming apparatus body 1, and so on.

Numeral 11 represents a finisher as a sheet processing apparatus and constitutes an image forming apparatus such as a photocopier, a printer, or the like upon connecting to the image forming apparatus body 1. Numeral 12 is a conveyance guide pair, receives sheets delivered from the delivery roller pair 2, and guides the sheets to the finisher 11. Numeral 13 is a sheet detection sensor and detects a sheet entering in the finisher 11. Numeral 14 is a delivery roller pair for conveying the sheet by nipping the sheet. Numeral 15 is a processing tray serving as a sheet stacking means and places the sheets delivered from the delivery roller pair 14 and stacks the sheets on the tray 15. Numeral 16 is an alignment plate constituting an alignment means, aligns orderly the sheets by guiding each end of the sheets delivered to the processing tray 15, and is disposed on each side in the width direction intersecting with the conveyance direction of the delivered sheets. Numeral 17 is a stopper for receiving a rear end of a sheet that is delivered to the processing tray 15 and falls by its weight. Numerals 18, 22 are rotary shafts; a first pulley 19 and a conveyance lower roller 20 are disposed on the one rotary shaft; a second pulley 26 is disposed on the other rotary shaft 22. Numeral 21 is a conveyance belt for constituting the conveying means, tensioned between the first pulley 19 and the second pulley 26, and is formed with a pushing pawl 23 on a part of an outer periphery of the belt. Numeral 24 is a conveyance upper roller and movable pivotally between a first position (separation position) shown in the drawing with a solid line and a second position (contact position) at which the conveyance lower roller 20 presses shown in the drawing with a one dot chain line.

Numerals 31, 32 are staplers as a binding means, which is constituted of a lower stapler 31 and an upper stapler 32 astride the conveyance route. The lower stapler 31 has a staple cartridge 33, a striking portion 34 for striking staple, and a staple feeding portion 35 for feeding staples from the staple cartridge 33 to the striking portion 34. The upper stapler 32 has a folding portion 36 for folding staples hit by the lower stapler 31. The lower stapler 31 pivotally moves around a shaft 37, and the upper stapler 32 pivotally moves around a shaft 38. The upper stapler 32 and the lower stapler 31 are movable along the respective shafts 37, 38 in a thrust direction (a sheet width direction intersecting with the sheet conveyance direction). The lower stapler 31 has a screw portion engaging with a screw shaft 39 having a spiral flute on an outer peripheral surface and is movable in the thrust direction according to the rotation of the screw shaft 39. The upper stapler 32 has a screw portion engaging with a screw shaft 40 having a spiral flute on an outer peripheral surface and is movable in the thrust direction according to the rotation of the screw shaft 40.

Numeral 41 is an up and down tray as a sheet tray means, is structured to be movable vertically (going up and down), and moves up approximately to a position shown with a two dot chain line in FIG. 1. Numeral 42 is a sheet surface detection sensor for detecting the topmost surface of the sheets stacked on the up and down tray 41. Numeral 43 is a rear end guide structured of a substantially vertical surface for guiding the rear end of each sheet on the up and down tray 4 moving vertically.

Numeral 51 is a conveyance guide serving as an escaping route and is a route for temporarily escaping a part of the sheet to face a center of the sheet to the pushing plate 55 as described below. The sheet is nipped and conveyed by the conveyance roller pair 20, 24. Numeral 52 is a rear end detection first sensor, structured of a reflection type photo sensor, and used for controlling the staple position when stapling operation is made. Numeral 53 is a rear end detection second sensor and is made of a transmission type photo sensor. Numeral 54 is a tension roller and compensates a sag by lightly pulling the sheet conveyed as nipped by the conveyance roller pair 20, 24. Numeral 55 is a pushing plate and is made of a plate having about 0.5 mm thickness of the tip of the plate in this embodiment. Numeral 56 is a folding roller pair in which both rollers push to each other and drive. The pushing plate 55 enters around the nip of the folding roller pair 56. Numeral 57 is a conveyance guide pair and guides the sheet bundle conveyed by nipping the sheet bundle by the folding roller pair 56. Numeral 58 is a discharge roller pair; one is a drive roller for rotating to drive; the other is a driven roller driven rotatively by pushed with the drive roller. Numeral 59 is a weight and serves for suppressing the discharged sheet bundle. Numeral 60 is a bundle sheet tray as a folded sheet tray means and stacks on the tray the sheet bundle discharged by the discharge roller pair 58.

Figure 2:
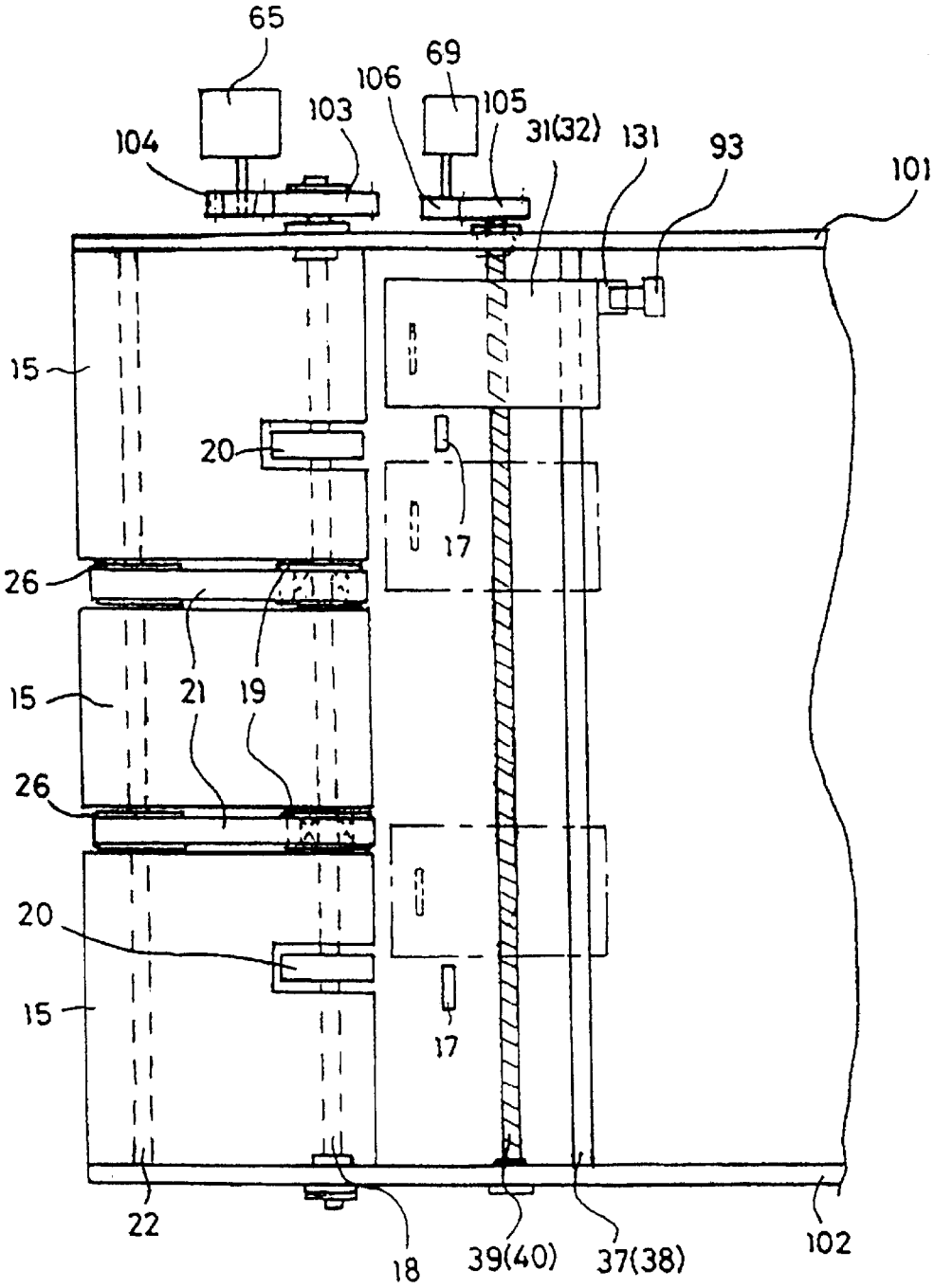
FIG. 2 is an exploded view showing a processing tray portion.

Referring to FIG. 2, a structure of the processing tray in the finisher is described in detail. FIG. 2 is an exploded view showing a processing tray portion.

In FIG. 2, rotary shafts 18, 22 are supported rotatively to frames 101, 102. The conveyance lower roller 20 is secured to the rotary shaft 18. The first pulley 19 is arranged on the rotary shaft 18. Within this first pulley 19, a known one-way clutch, not shown, is mounted, which rotatively drives in the counterclockwise direction of the rotary shaft 18 in FIG. 1 and which stops the first pulley 19 by cutting off the drive in rotation in the clockwise direction. A gear 103 is secured on the rotary shaft 18. A conveyance motor 65 has an output shaft to which a gear 104 is secured and is engaged with the gear 103. When the conveyance motor 65 rotates in a conveyance direction of the sheet to the up and down tray 41, drive force is transmitted through the gears 103, 104. At that time, the one-way clutch engages in the first pulley 19 to rotate the conveyance belt 21. When the conveyance motor 65 rotates in a direction reverse to the above direction, the one-way clutch cuts off the drive in the first pulley 19, so that the conveyance belt does not rotates.

Referring to FIGS. 1, 2, a movement structure of the staplers in the finisher is described in detail.

As described above, the screw portion of the lower stapler 31 described above is engaged with the flute of the screw shaft 39. A gear 105 is secured to the screw shaft 39. A staple shift motor 69 has an output shaft to which a gear 106 is secured and is in mesh with the gear 105. The rotation of the staple shift motor 69 is transmitted to the screw shaft 39 through the gears 105, 106. The opposite side of the gear 106 is in mesh with another gear, not shown, to drive the upper stapler 32, so that the upper stapler can move in the thrust direction in synchrony with the lower stapler 31. A flag 131 is formed at a part of the lower stapler 31, and a stapler home sensor 93 constituted of a photo sensor is placed at a position to render the sensor 93 make a detection where the staplers 31, 32 are in the home position.

Figure 3:
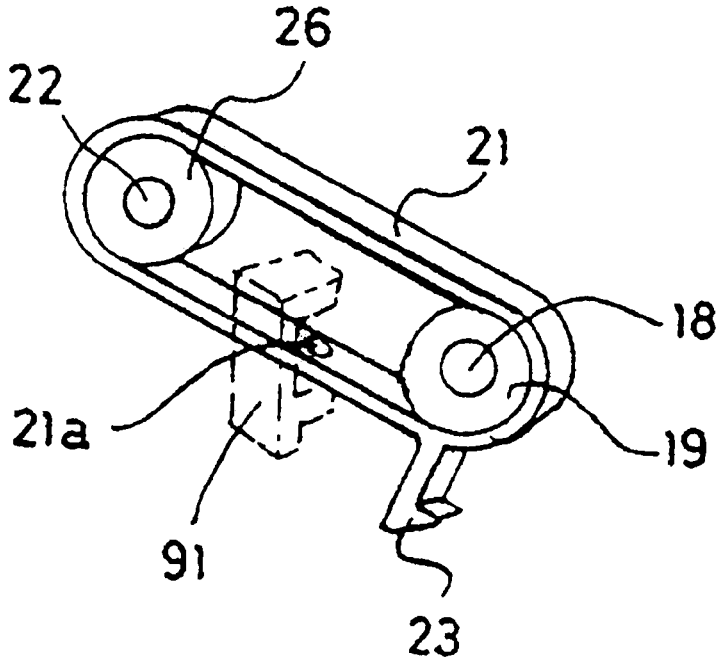
FIG. 3 is a perspective view showing a structure of a conveyance belt and its vicinity.
Figure 4:
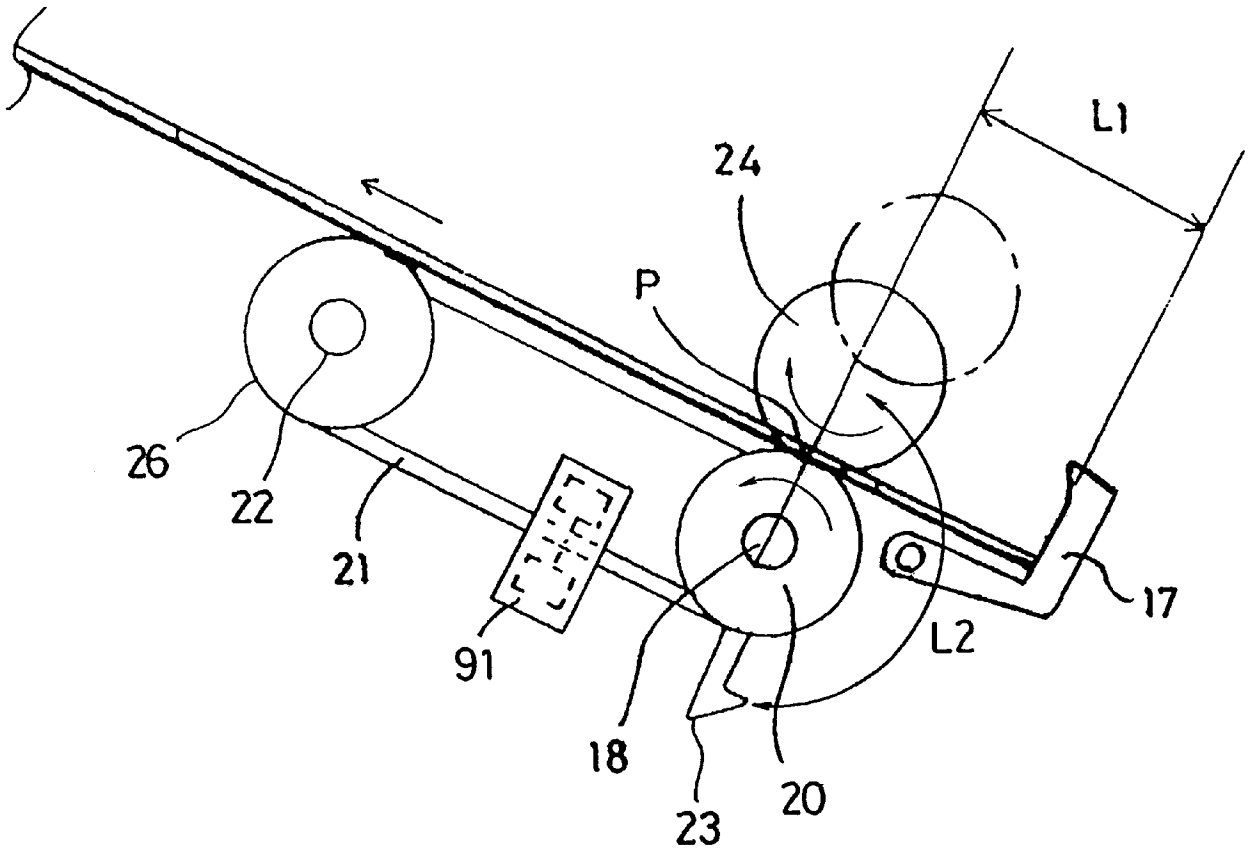
FIG. 4 is a side view showing the structure of the conveyance belt and its vicinity.

Referring to FIGS. 3, 4, a structure about a conveyance belt 21 and its vicinity is described in detail. FIG. 3 is a perspective view showing a structure of a conveyance belt and its vicinity; FIG. 4 is a side view showing the structure of the conveyance belt and its vicinity.

The conveyance belt 21 tensioned between the first pulley 19 and the second pulley 26 on the respective rotary shafts 18, 22 is formed with a hole 21*a* in the belt. Numeral 91 is a pushing pawl home sensor, which is a transmission type photo sensor. That is, when the pushing pawl home sensor 91 detects the hole 21*a* in the conveyance belt 21, the home position of the pushing pawl 23 of the conveyance belt 21 is detected. FIG. 4 shows a positional relation at that time. The nipping position between the conveyance lower roller 20 and the conveyance upper roller 24 is represented by letter P; the length from the nipping position P to the stopper 17 is represented by L1; the length from the nipping position P to the pushing nail 23 is represented by L2. The length relation here is set as L1<L2. The conveyance solenoid 66 is turned on to move the conveyance upper roller 24 down to a solid line position in FIG. 4, and the conveyance motor 65 starts rotating after the conveyance upper roller 24 presses the conveyance lower roller 20. When the rotary shaft 18 rotates in the counterclockwise direction (arrow direction in FIG. 4), the conveyance lower roller 20 rotates to convey the sheets in the arrow direction in FIG. 4. The sheets passes through the nipping position P between the conveyance roller pair 20, 24 and makes a stop. Subsequently, the pushing nail 23 hits the rear end of the sheet bundle according to rotational transfer on the conveyance upper belt 21, and the pushing pawl 23 conveys the sheets as pushing the sheets in a direction toward the up and down tray (FIG. 4 arrow direction).

Figure 5:
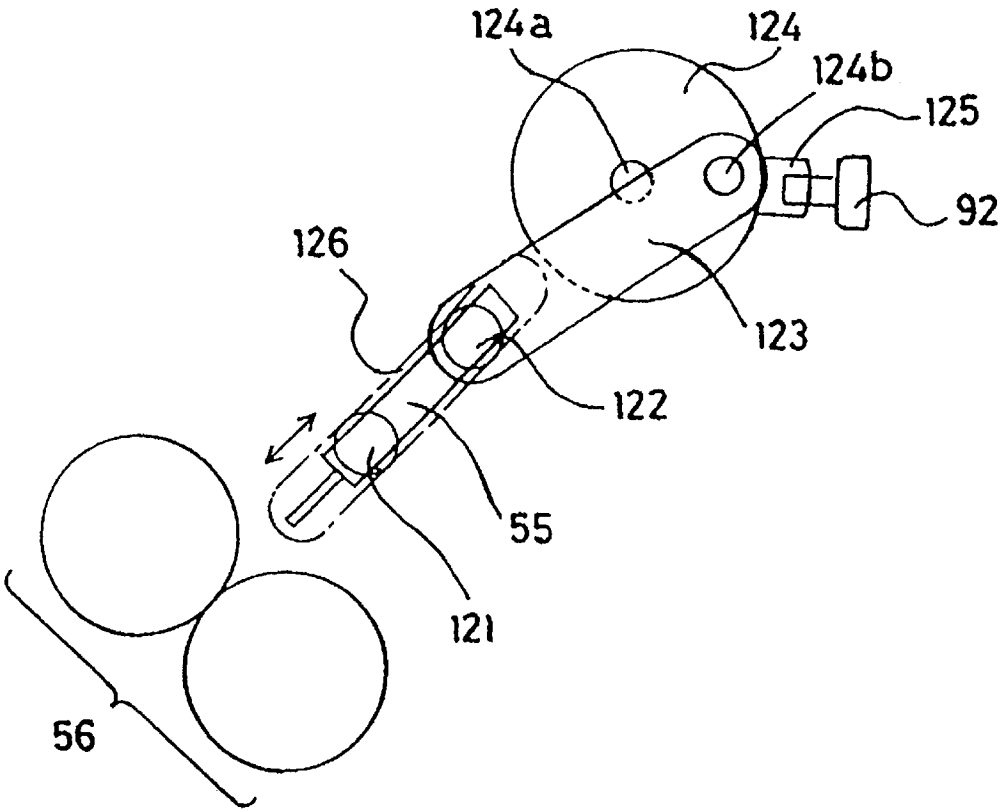
FIG. 5 is an illustration showing a structure of a folding portion.

Referring to FIG. 5, a structure of the pushing plate 55 constituting a folding means, a folding roller pair 56 and its vicinity is described next. FIG. 5 is an illustration showing a structure of a folding portion.

Rotation of a bundle folding motor 70 is converted from rotation of the folding roller pair 56 to parallel movement of the pushing plate 55 by a drive mechanism. A pushing plate clutch exists midway before the rotation is transmitted to the pushing plate 55, and when the pushing plate clutch 71 is turned on, rotation of the bundle folding motor 70 is transmitted to a rotary shaft 124*a*. A rotary plate 124 is mounted on the rotary shaft 124*a*. A shaft 124*b* and a flag 125 are mounted around an outer periphery of the rotary plate 124. The pushing plate home sensor 92 is made of a photo sensor and can detect the home position of the pushing plate 55 when the flag secured to the rotary plate 124 cuts off light. Numeral 55 is the pushing plate as described above and, in this embodiment, made of a thin plate of about 0.5 mm at an edge. Guide rollers 121, 122 are disposed on the respective ends of the pushing plate 55, so that the pushing plate 55 can move parallel in a guide groove 126. The linkage 123 is rotatably engaged with the guide roller 122 and the shaft 124*b*.

When the pushing plate clutch 71 is connected during rotation of the bundle folding motor 70, the rotary plate 124 begins rotating to render the pushing plate 55 move parallel toward the nipping position of the folding roller pair 56 by the linkage 123. The pushing plate 55, after guided near the nipping position of the folding roller pair 56, passes the remotest point from the nipping position of the folding roller pair 56 according to rotation of the rotary plate 124, and when the flag 125 comes to the pushing plate home sensor 92, the pushing plate clutch 71 is turned off.

It is to be noted that a distance L3 (see, Fig.) from the conveyance roller pair 20, 24 constituting the conveying means with the staplers 31, 32 to the pushing plate 55 and folding roller pair 56 constituting the folding means is structured to be a half or more than the length of the foldablelargest sheet in the conveyance direction. That is, when the pushing plate 55 and the folding roller pair 56 constituting the folding means perform folding operation for sheets, the conveyance roller pair 20, 24 constituting the conveyance mean does not disturb the folding operation.

Figure 6:
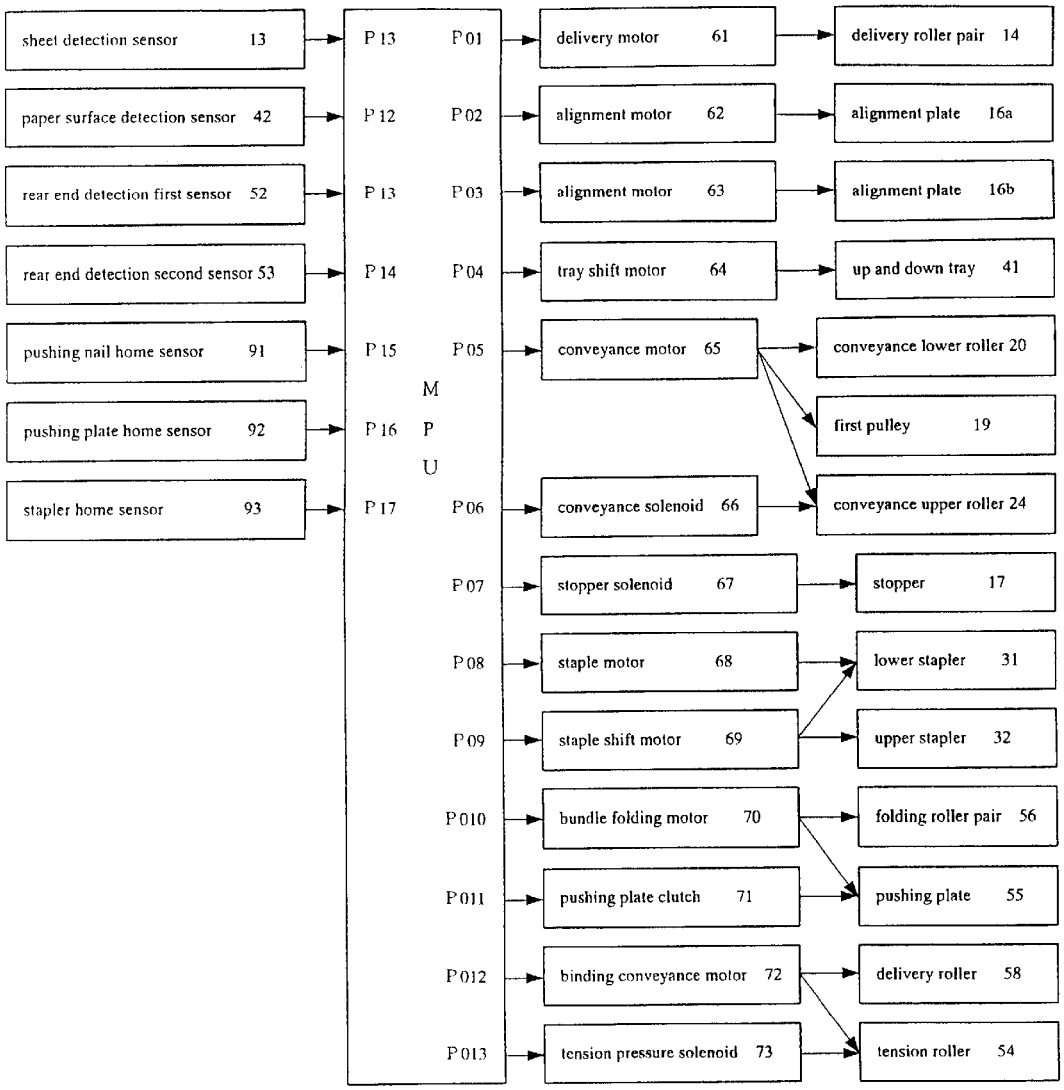
FIG. 6 is a block diagram showing a structure of a control system of the finisher 11.

Now, referring to FIG. 6, a structure of a control system of the finisher 11 as the sheet processing apparatus is described briefly.

In FIG. 6, an MPU as a control means for controlling the entire apparatus receives signals from the sheet detection sensor 13, the sheet surface detection sensor 42, the rear end detection first sensor 52, the rear end detection second sensor 53, the pushing pawl home sensor 91, the pushing plate home sensor 92, and the stapler home sensor 93, which are connected to respective input ports P11 to P17.

Based on the above signals, the MPU controls, through respective drives, the delivery motor 61, the alignment motor 62, the alignment motor 63, the tray shift motor 64, the conveyance motor 65, the conveyance solenoid 66, the stopper solenoid 67, the staple motor 68, the staple shift motor 69, the bundle folding motor 70, the pushing plate clutch 71, the binding conveyance motor 72, and the tension pressing solenoid 73, which are connected to respective output ports PO01 to PO 13.

Operation of the finisher thus structured when one of respective processing modes is selected is described next.

[When Stack Mode is Selected]

First, operation of the finisher when the stack mode is selected is described. When a sheet delivered from the delivery roller pair 2 in the image forming apparatus 1 is detected by the sheet detection sensor 13, the delivery motor 61 starts rotating, thereby rotating the delivery roller pair 14. The delivery motor 61 is rotated at least more than an amount that the rear end of the sheet passes the nipping portion of the delivery roller pair 14. This makes the sheet delivered on the processing tray 15 and stacked on the tray. Subsequently, the alignment motors 62, 63 are rotated to contact both ends of the sheets on the processing tray 15 with the alignment plates 16*a*, 16*b* by moving the alignment plates 16*a*, 16*b* in the sheet width direction intersecting to the sheet conveyance direction, and the sheets arc aligned orderly. This operation is to be repeated for times of a prescribed sheet number.

Then, the conveyance solenoid 66 is turned on to push the conveyance upper roller 24 on the conveyance lower roller 20 in a direction that the conveyance upper roller 24 comes in contact with the conveyance lower roller 20. Where the conveyance motor is rotated subsequently, the conveyance roller pair 20, 24 are rotated as to convey the aligned sheets as described above in a direction to the up and down tray 41, and the conveyance belt 21 begins conveying the sheets according to rotation of the first pulley 19. As described in the above referring to FIG. 4, the sheet rear end is passed to the conveyance roller pair 20 and then to 24, pushing pawl 23, and is finally stacked on the up and down tray 41. The up and down tray 41 is made to go down for a prescribed amount by rotating the tray shift motor 64, and then, the up and down tray 41 is moved up by reversing the tray shift motor 64. At that time, the sheet surface detection sensor 42 detects the top surface (topmost surface) of the stacked sheets, the drive of the tray shift motor 64 is stopped.

[When Staple Mode is Selected]

Operation of the finisher when the staple mode is selected is described next. It is to be noted that a sequence that a desired number of sheets are delivered, stacked, and aligned on the processing tray 15 is the same sequence as that of the stack mode, and here a description is omitted.

After sheets are aligned, the staplers 31, 32 make stapling at one or more locations at the edge of the sheets on the processing tray 15. In this embodiment, the stapler motor 69 and the staple shift motor 69 are driven to move the staplers 31, 32 to a position shown with a solid line in FIG. 2 to make a binding at a single position or to move the staplers 31, 32 successively to positions shown with one dot chain lines in FIG. 2 to make a binding at two positions. After the binding processing is over, the sheet is moved on to the up and down tray 41 by the conveyance roller pair 20, 24, the conveyance belt 21, and the pushing pawl 23 formed on the conveyance belt 21 in substantially the same manner as the stack mode as described above.

[When Stitch Mode is Selected]

Operation of the finisher when the stitch mode is selected is described next. First, in the same manner as the stack mode as described above, after the sheets are stacked on the processing tray 15 and orderly aligned, the conveyance solenoid 66 is turned on. The sheets are thus nipped by the conveyance roller pair 20, 24. Where the stopper solenoid 67 is turned on, the stopper 17 is moved from the solid line position in FIG. 1 to the two-dot chain line position. Therefore, the conveyance route is opened so that the sheets can be conveyed in a second direction (arrow b direction), which is opposed to a first direction (arrow a direction in FIG. 1).

The conveyance motor 65 is rotated in a direction reverse to the direction of the stack mode or staple mode, and the sheets nipped by the conveyance roller pair 20, 24 are conveyed in the above second direction (arrow b direction). When the sheet is detected by the rear end detection first sensor 52, the conveyance motor 65 is rotated in a prescribed amount to convey the sheet to a position such that the center or the vicinity in the conveyance direction of the sheet matches the binding position based on size information previously sent and stop the sheet. The staplers 31, 32 are moved successively at the one dot chain positions shown in FIG. 2 to make two-position binding.

After binding operation is over, the conveyance motor is further reversely rotated to convey the sheets in the second direction more. The tension pressure solenoid 73 is turned on to press the tension roller 54, thereby conveying the sheets. The conveyance force of the tension roller 54 is designed smaller than the conveyance force of the conveyance roller pair 20, 24 and is just as to remove a sag of the sheets. When the rear end detection second sensor 53 detects the sheets, the conveyance motor 65 is stopped as reducing in the rotation speed so that the center portion or the vicinity of the sheets in the conveyance direction, namely, the binding position matches the folding position.

Subsequently, the bundle folding motor 70 is rotated, and the pushing plate clutch 71 is turned on. The pushing plate 55 is moved toward the nipping position of the folding roller pair 56 and moves the sheets so that the binding position of the sheets are nipped by the folding roller pair 56. The pushing plate 55 starts moving in a direction separating from the sheets at a position where the sheets are pulled in the rotating folding roller pair 56. When the pushing plate home sensor 92 detects the home position of the pushing plate 55 as shown in FIG. 5, the pushing plate clutch 71 is turned off to stop driving of the pushing plate 55. Subsequently, the binding conveyance motor 72 is rotated, the sheets are nipped and conveyed, as folded by the discharge roller pair 58. The sheets are transferred in the conveyance guide 57 as folded in folio and discharged and stacked on the bundle sheet tray 60 as guided by the weight 59.

[When Folding Mode is Selected]

Operation of the finisher when the folding mode is selected is described next. Although the folding processing is made after the binding processing when the stitch mode is selected, the folding processing can be done at any position without implementing any binding processing according to this finisher.

First, in the same manner as the stack mode as described above, after the sheets are stacked on the processing tray 15 and orderly aligned, the conveyance solenoid 66 is turned on. The sheets are thus nipped by the conveyance roller pair 20, 24. Where the stopper solenoid 67 is turned on, the stopper 17 is moved from the solid line position in FIG. 1 to the two-dot chain line position. Therefore, the conveyance route is opened so that the sheets can be conveyed in a second direction (arrow b direction), which is opposed to a first direction (arrow a direction in FIG. 1).

The conveyance motor 65 is rotated in a direction reverse to the direction of the stack mode or staple mode, and the sheets nipped by the conveyance roller pair 20, 24 are conveyed in the above second direction (arrow b direction). The tension pressure solenoid 73 is turned on to press the tension roller 54, thereby conveying the sheets. When the sheet is detected by the rear end detection second sensor 53, the conveyance motor 65 is made slower and stopped so that any desired folding position (e.g., the center or the vicinity in the conveyance direction of the sheet) matches the pushing plate 55 based on size information previously sent.

Subsequently, the bundle folding motor 70 is rotated, and the pushing plate clutch 71 is turned on. The pushing plate 55 is moved toward the nipping position of the folding roller pair 56 and moves the sheets so that the desired folding position of the sheets are nipped by the folding roller pair 56. The pushing plate 55 starts moving in a direction separating from the sheets at a position where the sheets are pulled in the rotating folding roller pair 56. When the pushing plate home sensor 92 detects the home position of the pushing plate 55 as shown in FIG. 5, the pushing plate clutch 71 is turned off to stop driving of the pushing plate 55. Subsequently, the binding conveyance motor 72 is rotated, the sheets are nipped and conveyed by the discharge roller pair 58. The sheets are discharged and stacked on the bundle sheet tray 60 as guided by the weight 59.

According to the above embodiments, in comparison with an apparatus having a structure of the finisher unit and the stitcher unit separately arranged as in the prior art, because the invented apparatus has a structure commonly having the stapler, the conveying means, aligning means, and the like, the apparatus can be provided with lower costs, compact size, and fewer useless spaces, where each unit is not required to perform binding processing likewise in a conventional apparatus.

[Other Embodiments]

Figure 7:
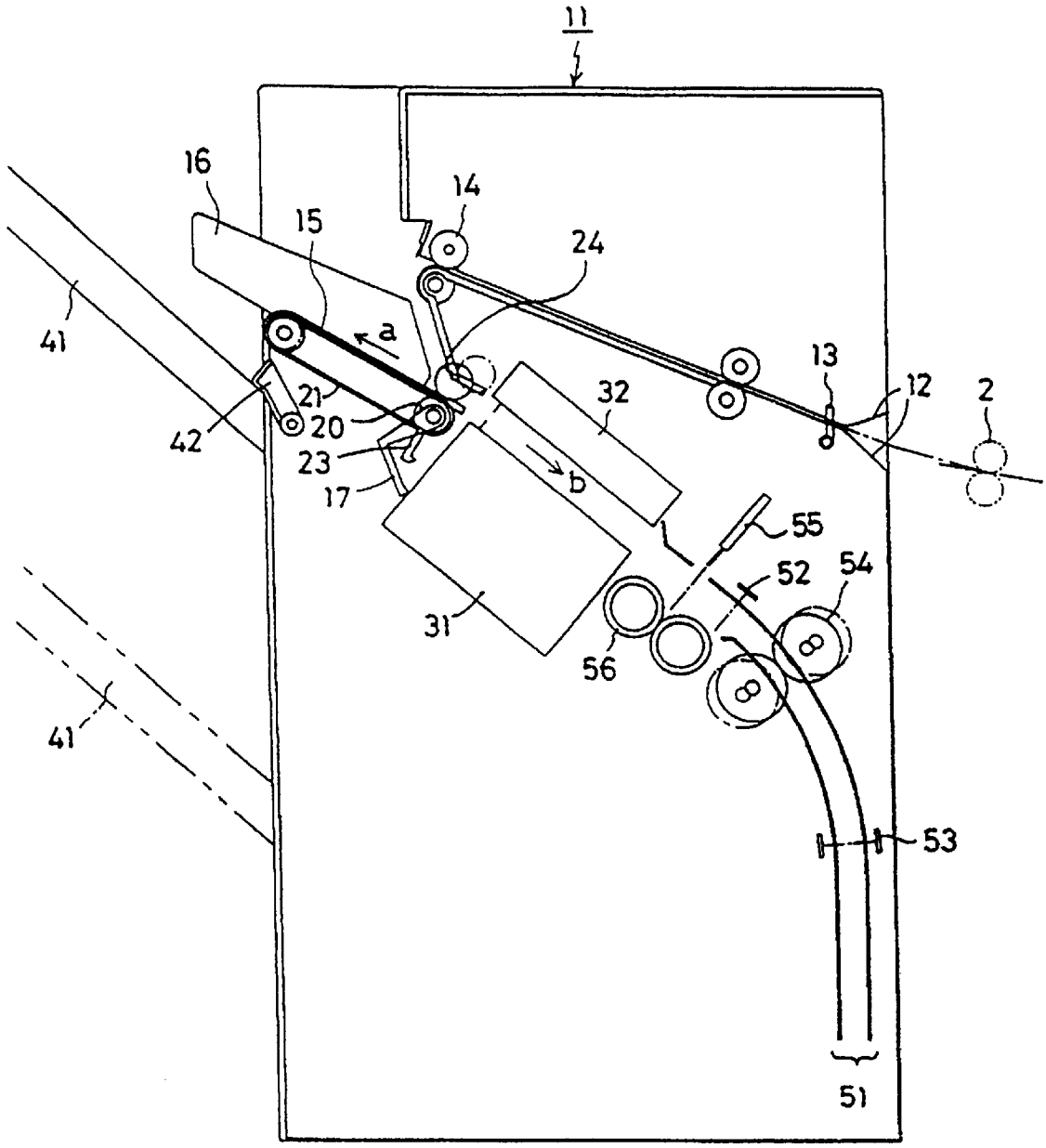
FIG. 7 is a main cross section showing a finisher according to another embodiment.

In the above first embodiment, the sheets subject to the folding processing at the folding roller pair 56 are nipped by the discharge roller pair 58 and conveyed to stack on the bundle sheet tray 60, but the mechanism can be structured as shown in FIG. 7. That is, the sheets subject to the folding processing at the folding roller pair 56 are not conveyed to the conveyance guide pair 57 shown in FIG. 1, but the folding roller pair 56 is rotated in the reverse direction. The conveyance motor 65 is reversed to convey the sheets subject to the folding processing in the first direction (arrow a direction in FIG. 7) to be delivered to the up and down tray 41 as first tray means. When the rear end of the sheets passes the nipping position of the conveyance roller pair 20, 24, the pushing pawl 23 of the conveyance belt 21 pushes the rear end of the sheets to discharge and stack the sheets on the up and down tray 41. With this structure, stapled sheets having a folded line, in addition to the stack mode, staple mode, can be stacked on the up and down tray 41. Therefore, an apparatus can be provided with lower costs, a compact size, and fewer useless spaces.

In the embodiments described above, a photocopier is exemplified as an image forming apparatus, but the invention is not limited to this structure. The image forming apparatus can be, e.g., a printer, a facsimile machine, or other image forming apparatuses, and substantially the same advantages can be obtained where the invention applies to the sheet processing apparatus used in the image forming apparatus.

Although in the embodiments described above the sheet processing apparatus detachably attached to the image forming apparatus is exemplified, this invention is not limited to this structure. For example, the image forming apparatus may have a sheet processing apparatus as a united body, and substantially the same advantages can be obtained where the invention applies to the sheet processing apparatus.

In the embodiments described above, the electrophotographic system is exemplified as the recording method. This invention is not limited to this structure, and for example, inkjet printing system or the like can be used for the recording method.

To accomplish the above object, a representative structure of the invention includes: sheet stacking means for stacking sheets; sheet tray means for supporting the sheets to be delivered after stacked on the sheet stacking means; conveying means for conveying the sheets stacked on the sheet stacking means in a direction toward the sheet tray means and to a direction opposed to the direction toward the sheet tray means; and sheet binding means for binding a sheet bundle stacked on the sheet stacking means or a sheet bundle stacked on the sheet stacking means and conveyed in the direction opposed to the direction toward the sheet tray means by the conveying means.

As explained above, the apparatus includes the conveying means capable of conveying the sheet in a direction toward the sheet tray means and a direction opposed to the direction, and the sheet binding means can make binding operation at various positions, e.g., at an end of the sheet bundle or at or around a center position. As a result, the sheet binding means, the conveying means can be used commonly, so that the costs for parts can be reduced, and so that a compact sheet processing apparatus can be provided in terms of apparatus capacity.

By providing sheet folding means on a downstream side of the binding means, folding operation at or around a center portion can be done in succession to binding operation to the center portion. Such a sheet folding means is to fold, in a direction perpendicular to the conveyance direction, the sheet or sheets conveyed in the conveyance direction, and furthermore, the sheet folding means may fold the center portion in the conveyance direction of the sheet.

Where the sheet processing apparatus has a structure having alignment means for aligning the sheets stacked on the sheet stacking means in a conveyance direction of the conveying means and in a sheet width direction perpendicular to the conveyance direction, binding operation can be done as the sheet bundle are aligned orderly.

Where the sheet binding means has a structure that is movable in a sheet width direction perpendicular to the sheet conveyance direction of the conveying means and performs binding operation at an end of the sheet bundle stacked on the sheet stacking means or at or around a center position in the conveyance direction of the sheet bundle stacked on the sheet stacking means and conveyed by the conveying means in a direction opposed to the direction toward the sheet tray means, the sheet bundles can be bound selectively at two type positions using the common sheet binding means.

The sheet processing apparatus may have a folded sheet tray means on a downstream side in a sheet folding direction for delivering a folded sheet that is folded by the sheet folding means; the sheet processing apparatus may have a conveyance guide disposed between the sheet folding means and the sheet tray means for guiding conveyance of the folded sheets, and the sheet may be conveyed as folded by the sheet folding means through the conveyance guide and delivered to the folded sheet tray means.

Where a sheet conveyance distance from the conveyance means to sheet folding means is made equal to or more than a half of a maximum length in the conveyance direction of the sheet foldable by the sheet folding means, the conveying means does not hold the sheet end during the folding operation, so that the quality of the folding processing can be guaranteed.

A sheet escaping route may be arranged on a further downstream side of the sheet folding means in a conveyance direction in the sheet binding means for escaping the sheets conveyed by the conveying means, and the sheet binding means can be placed at or around a center of the sheet bundle by escaping a part of the sheet bundle in the sheet escaping route.

The conveying means may have the structure including: a first pulley and a second pulley rotatably supported on respective shafts, a belt member tensioned between the first and second pulleys having a nail member capable of contacting to the sheet, a transmitting means for transmitting drive to a rotary shaft supporting the first pulley, a conveyance lower roller supported by the rotary shaft supporting the first pulley; a conveyance upper roller capable of contacting with and separating from the conveyance lower roller, and a stopper positionally changeable for limiting an end of the sheet stacked on the sheet stacking means on a side opposed to the sheet tray means. With such a structure, the nail member can convey the sheet bundle as aligning the sheet end orderly, and since the top surface of the conveying means becomes a flat surface, the top surface may serve as a part of the aligning means.

Furthermore, the first pulley has a structure having a rotation limiting member for limiting rotation toward the direction in opposition to the direction to the sheet tray means. The sheet processing apparatus may have an initial position sensor detecting the position of the nail member formed on the belt member, where the initial position of the nail member is set at a remote position on the belt member greater than the distance from the contact position between the conveyance lower roller and the conveyance upper roller to the stopper, so that the nail member can be prevented from contacting to the conveyance upper roller.

An image forming apparatus may be constituted of the sheet processing apparatus having the above structure and recording means, and substantially the same effects and advantages can be obtained.

What is claimed is:

1. A sheet processing apparatus comprising:

sheet stacking means for stacking a sheet to be conveyed and bound;

conveying means for conveying the sheet stacked on the sheet stacking means so as to change sheet binding positions; and sheet binding means for binding a sheet bundle stacked on the sheet stacking means, wherein, in case of an end binding mode, a moveable stopper aligns an end of the sheets to be a sheet bundle stacked on the sheet stacking means and the sheet bundle is bound at the end of the sheets, and wherein, in case of a central binding mode, the moveable stopper aligns an end of the sheet to be a sheet bundle stacked on the sheet stacking means, the conveying means conveys the sheet bundle in certain distance to position the center of the sheet bundle at the sheet binding means, and the sheet binding means binds the sheet bundle.

2. The sheet processing apparatus according to claim 1, further comprising sheet folding means, disposed in a downstream side of a conveying direction of the sheet binding means, for folding the sheet conveyed to correspond a center of the sheet to the sheet folding means by the conveying means from the sheet stacking means.

3. The sheet processing apparatus according to claim 1, further comprising the stopper for aligning the sheet stacked on the sheet stacking means in a sheet width direction perpendicular to the sheet conveyance direction.

4. The sheet processing apparatus according to claim 1, wherein the sheet binding means is movable in a sheet width direction perpendicular to a sheet conveyance direction of the conveying means, and wherein the sheet binding means binds at one of a end of the sheets stacked on the sheet stacking means and an approximate center of the sheets conveyed in the direction from the sheet stacking means toward the sheet binding means by the conveying means.

5. The sheet processing apparatus according to claim 2, wherein the sheet folding means folds in a direction perpendicular to a conveyance direction the sheets conveyed by the conveying means.

6. The sheet processing apparatus according to claim 5, wherein the sheet folding means folds the sheets approximately at a center of the sheets bound by the sheet binding means.

7. The sheet processing apparatus according to claim 2, further comprising a folded sheet tray means, disposed in a downstream side in a direction so as to fold the sheet conveyed by the conveying means, for discharging the sheet folded by the sheet folding means.

8. The sheet processing apparatus according to claim 7, further comprising a conveyance guide, disposed between the sheet folding means and the folded sheet tray means, for guiding conveyance of the folded sheet, wherein the folded sheet conveys through the conveyance guide and is discharged to the folded sheet tray means.

9. The sheet processing apparatus according to claim 2, wherein a distance from the conveying means to the sheet folding means is at least a half of a length in a conveyance direction of a maximum sheet foldable by the sheet folding means.

10. A sheet processing apparatus according to claim 1, the sheet processing apparatus further comprising, sheet tray means for supporting the sheet delivered after the sheet is stacked and bound on said sheet stacking means and said conveying means conveys the sheet stacked on said sheet stacking means.

11. The sheet processing apparatus according to claim 10, wherein the conveying means comprises: a first pulley and a second pulley rotatably supported on respective shafts, a belt member tensioned between the first and second pulleys having a pawl member capable of contacting to the sheet, a transmitting means for transmitting drive to a rotary shaft supporting the first pulley, a conveyance lower roller supported by the rotary shaft supporting the first pulley, a conveyance upper roller capable of contacting with and separating from the conveyance lower roller, and the stopper positionally changeable for limiting and end of the sheet stacked on the sheet stacking means on a side opposed to the sheet tray means.

12. The sheet processing apparatus according to claim 11, wherein the first pulley has a rotation regulating member for regulating rotation to the direction toward the sheet binding means.

13. The sheet processing apparatus according to claim 11, further comprising an initial position sensor detecting the position of the pawl member formed on the belt member, wherein an initial position of the pawl member is set at a remote position on the belt member greater than the distance from the contact position between the conveyance lower roller and the conveyance upper roller to the stopper.

14. An image forming apparatus comprising:

image forming means for forming an image on a sheet;

sheet stacking means for stacking a sheet to be conveyed and bound;

conveying means for conveying the sheet stacked on the sheet stacking means so as to change sheet binding positions; and sheet binding means for binding a sheet bundle stacked on the sheet stacking means, wherein, in case of an end binding mode, a moveable stopper aligns an end of the sheets to be a sheet bundle stacked on the sheet stacking means and the sheet bundle is bound at the end of the sheets, and wherein, in case of a central binding mode, the moveable stopper aligns an end of the sheet to be a sheet bundle stacked on the sheet stacking means, the conveying means conveys the sheet bundle in certain distance to position the center of the sheet bundle at the sheet binding means, and the sheet binding means binds the sheet bundle.

15. The image forming apparatus according to claim 14, further comprising sheet folding means, disposed in a downstream side of a conveying direction of the sheet binding means, for folding the sheet conveyed by the conveying means from the sheet stacking means.

16. The image forming apparatus according to claim 14, further comprising the stopper for aligning the sheet stacked on the sheet stacking means in a sheet width direction perpendicular to the sheet conveyance direction.

17. The image forming apparatus according to claim 14, wherein the sheet binding means is movable in a sheet width direction perpendicular to a sheet conveyance direction of the conveying means, and wherein the sheet binding means binds at one of a end of the sheets stacked on the sheet stacking means and an approximate center of the sheets conveyed in the direction from the sheet stacking means toward the sheet binding means by the conveying means.

18. The image forming apparatus according to claim 15, wherein the sheet folding means folds in a direction perpendicular to a conveyance direction the sheets conveyed by the conveying means.

19. The image forming apparatus according to claim 18, wherein the sheet folding means folds the sheets approximately at a center of the sheets bound by the sheet binding means.

20. The image forming apparatus according to claim 15, further comprising a folded sheet tray means, disposed in a downstream side in a direction so as to fold the sheet conveyed by the conveying means, for discharging the sheet folded by the sheet folding means.

21. The image forming apparatus according to claim 20, further comprising a conveyance guide, disposed between the sheet folding means and the folded sheet tray means, for guiding conveyance of the folded sheet, wherein the folded sheet conveys through the conveyance guide and is discharged to the folded sheet tray means.

22. The image forming apparatus according to claim 15, wherein a sheet conveyance distance from the conveying means to the sheet folding means is at least a half of a length in a conveyance direction of a maximum sheet foldable by the sheet folding means.

23. An image forming apparatus according to claim 14, the image forming apparatus further comprising, sheet tray means for supporting the sheet delivered after the sheet is stacked and bound on said sheet stacking means and said conveying means conveys the sheet stacked on said sheet stacking means in a direction away from said sheet tray means.

24. The image forming apparatus according to claim 23, wherein the conveying means comprises: a first pulley and a second pulley rotatably supported on respective shafts, a belt member tensioned between the first and second pulleys having a pawl member capable of contacting to the sheet, a transmitting means for transmitting drive to a rotary shaft supporting the first pulley, a conveyance lower roller supported by the rotary shaft supporting the first pulley, a conveyance upper roller capable of contacting with and separating from the conveyance lower roller, and the stopper positionally changeable for limiting an end of the sheet stacked on the sheet stacking means on a side opposed to the sheet tray means.

25. The image forming apparatus according to claim 24, wherein the first pulley has a rotation regulating member for regulating rotation to the direction toward the sheet binding means.

26. The image forming apparatus according to claim 24, further comprising an initial position sensor detecting the position of the pawl member formed on the belt member, wherein an initial position of the pawl member is set at a remote position on the belt member greater than the distance from the contact position between the conveyance lower roller and the conveyance upper roller to the stopper.

27. A sheet processing apparatus according to claim 1, wherein in case of the end binding mode, said movable stopper stays at an aligning position and said sheet bundle is bound at the end of the sheets by the sheet binding means, and wherein, in case of a central binding mode, the moveable stopper aligns an end of the sheet to be a sheet bundle stacked on the sheet stacking means, then after the moveable stopper is moved, the conveying means conveys the sheet bundle in certain distance to position the center of the sheet bundle at the sheet binding means, and the sheet binding means binds the sheet bundle.

28. The sheet processing apparatus according to claim 2, further comprising a sheet escaping route, arranged on a further downstream side of the sheet folding means, for escaping an edge of the sheet conveyed by the conveying means from the sheet stacking means tot he sheet folding means.

29. An image forming apparatus according to claim 14, wherein in case of the end binding mode, said moveable stopper stays at an aligning position and said sheet bundle is bound at the end of the sheets by the sheet binding means.

30. The image forming apparatus according to claim 15, further comprising a sheet escaping route, arranged on a further downstream side of the sheet folding means, for escaping an edge of the sheet conveyed by the conveying means from the sheet stacking means to the sheet folding means.

31. A sheet processing apparatus comprising:

sheet stacking means for stacking a sheet to be conveyed and bound;

conveying means for conveying the sheet stacked on the sheet stacking means; and sheet binding means for binding a sheet bundle stacked on the sheet stacking means, wherein, in case of a central binding mode, the moveable stopper aligns an end of the sheet to be a sheet bundle stacked on the sheet stacking means, then after the moveable stopper is moved, the conveying means conveys the sheet bundle a certain distance to position the center of the sheet bundle at the sheet binding means, and the sheet binding means binds the sheet bundle.

32. A sheet processing apparatus according to claim 27, the sheet processing apparatus further comprising, sheet tray means for supporting the sheet delivered after the sheet is stacked and bound on said sheet stacking means and said conveying means conveys the sheet stacked on said sheet stacking means, wherein, in case of a non-binding mode, the conveying means conveys the sheet bundle stacked on the sheet stacking means to the sheet tray means.

* * * * *

UNITED STATES PATENT AND TRADEMARK OFFICE

CERTIFICATE OF CORRECTION

PATENT NO. : 6,779,790 B2
DATED : August 24, 2004
INVENTOR(S) : Yoshihiko Kitahara It is certified that error appears in the above-identified patent and that said Letters Patent is hereby corrected as shown below:

Title page,
Item [57], ABSTRACT,
Line 3, “a” should be deleted.
Line 9, “he” should read -- be --.

Column 1,
Line 10, “a” should be deleted.
Line 61, “is” should read -- are --.

Column 2,
Line 9, “multiply” should read -- multiple --.
Line 20, “a” should be deleted.

Column 4,
Line 14, “by” should read -- by being --.
Line 40, “rotates.” should read -- rotate. --.

Column 5,
Line 15, “passes” should read -- pass --.
Line 60, “foldablelargest” should read -- foldable largest --.
Line 64, “mean” should read -- means --.

Column 6,
Line 33, “arc” should read -- are --.

Column 9,
Line 53, “bundle” should read -- bundles --.

Column 11,
Line 1, “in certain” should read -- a certain --.
Line 18, “a” should read -- an --.

Column 12,
Line 25, “in certain” should read -- a certain --.
Line 42, “a” should read -- an --.

Column 13,
Line 41, “in certain” should read -- a certain --.

UNITED STATES PATENT AND TRADEMARK OFFICE

CERTIFICATE OF CORRECTION

PATENT NO. : 6,779,790 B2
DATED : August 24, 2004
INVENTOR(S) : Yoshihiko Kitahara It is certified that error appears in the above-identified patent and that said Letters Patent is hereby corrected as shown below:

Column 14,
Line 5, “tot he” should read -- to the --.

Signed and Sealed this

Twentieth Day of December, 2005

JON W. DUDAS
*Director of the United States Patent and Trademark Office*